US006102239A

United States Patent [19]

Wien

[11] Patent Number: 6,102,239

[45] Date of Patent: Aug. 15, 2000

[54] PACKING AND WASTE DISPOSAL SYSTEM

[76] Inventor: Abraham Wien, 11990 SW. 94 Ct., Miami, Fla. 33176

[21] Appl. No.: 09/426,270

[22] Filed: Oct. 25, 1999

[51] Int. Cl.[7] ..... B65D 25/00

[52] U.S. Cl. ..... 220/495.07; 220/908.1; 383/37

[58] Field of Search ..... 220/495.07, 495.09, 220/495.1, 495.11, 908.1; 383/37

[56] References Cited

U.S. PATENT DOCUMENTS

| | | | |
|---|---|---|---|
| 4,577,778 | 3/1986 | Kim | 220/495.07 |
| 5,097,950 | 3/1992 | Weiss et al. | 220/495.7 X |

*Primary Examiner*—Steven Pollard
*Attorney, Agent, or Firm*—Caesar, Rivise, Bernstein, Cohen & Pokotilow, Ltd.

[57] ABSTRACT

An improved material packaging system having a plurality of nested liners that are removably attached to each other to form a unitary liner structure. A receptacle having a first attachment device for detachably securing the unitary liner structure to the receptacle is set forth. The unitary liner structure has a second attachment device for detachably securing the second attachment device to the first attachment device of the receptacle. Each of the liners has a pull grip for gripping the liner to remove the liner from the unitary liner structure and perforations disposed between the pull grip and the second attachment device for tearing the liner when a tearing force is applied thereto. An uppermost liner of the plurality of liners can thus be removed from the unitary liner structure without substantially disturbing the positioning of underlying liners by gripping and pulling the pull grip of the uppermost liner to apply the tearing force to the perforations of the uppermost liner. The second attachment device extends around an entire circumference of the unitary liner structure and can be a drawstring. The second attachment device can be a sheath for retaining the drawstring. Both the sheath and the drawstring extending around an entire circumference of the unitary liner structure as well as the perforations being disposed in a line are also taught.

21 Claims, 5 Drawing Sheets

FIG. 1
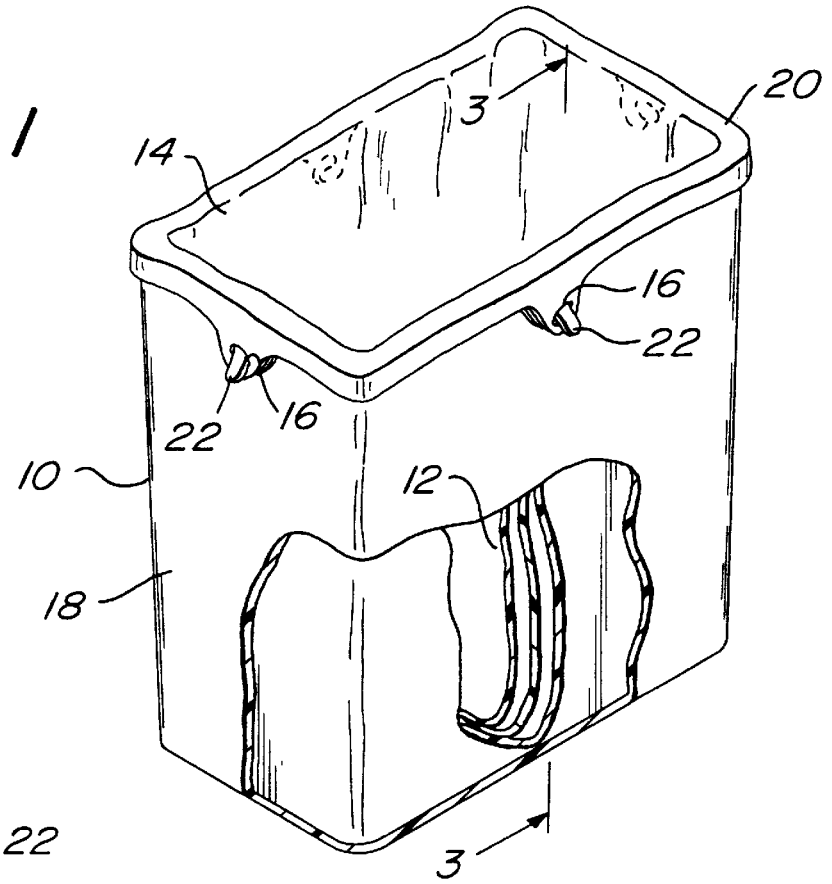
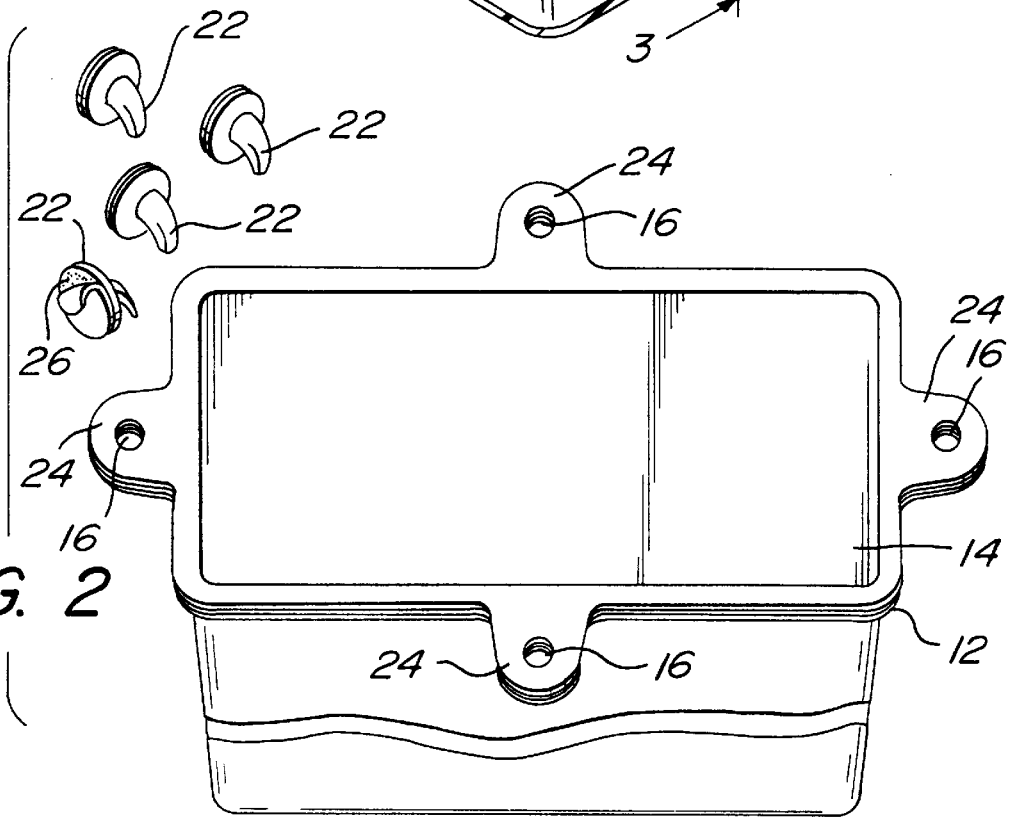
FIG. 2

FIG. 3
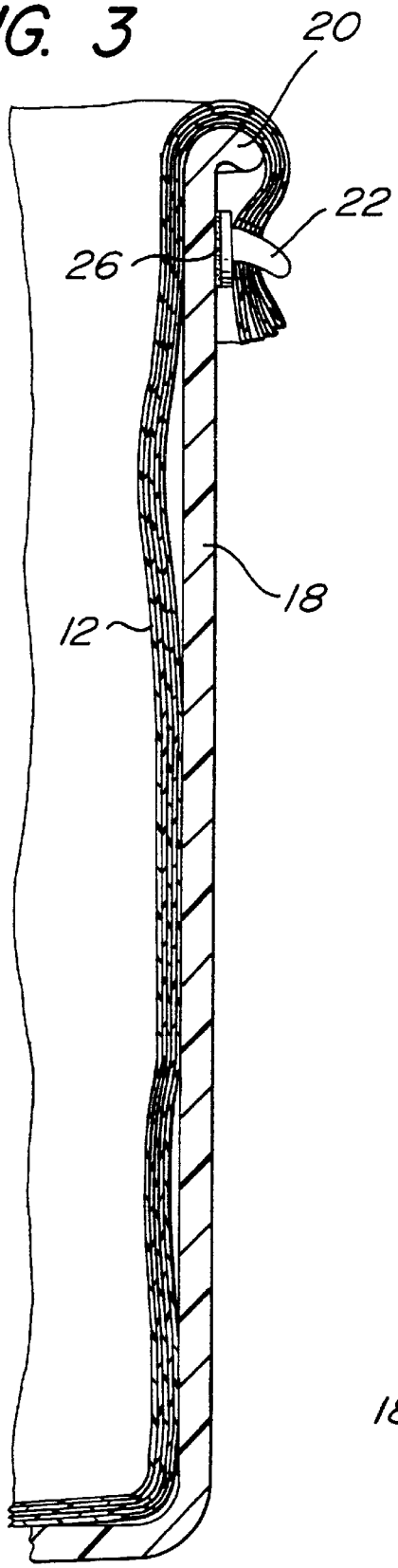
FIG. 4
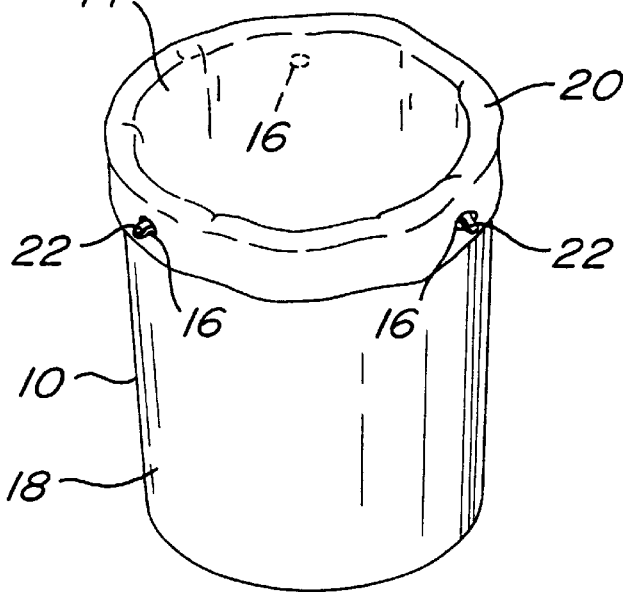
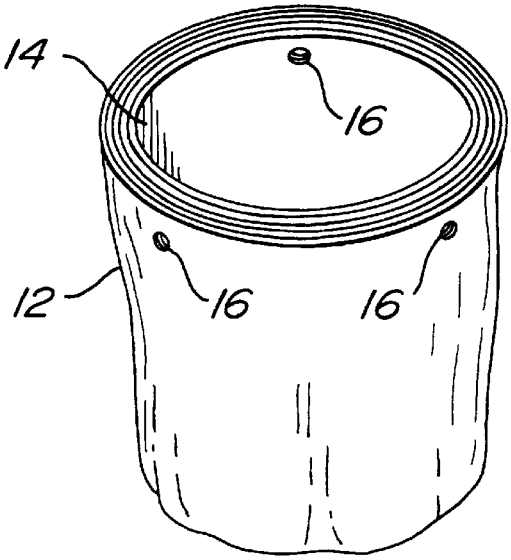
FIG. 5
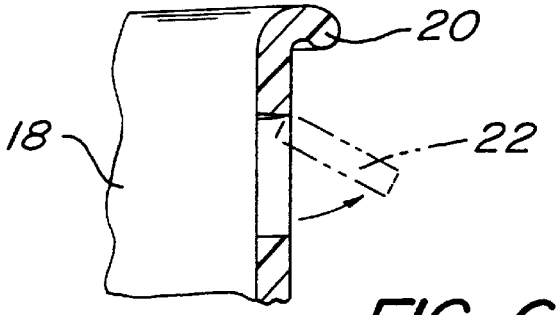
FIG. 6

PACKING AND WASTE DISPOSAL SYSTEM

FIELD OF THE INVENTION

This invention relates to packaging and waste disposal systems in general, and particularly to packaging receptacles and waste disposal receptacles incorporating means for removably retaining a plurality of nested liners.

BACKGROUND OF THE INVENTION

Lined receptacles have long been known, but two constant problems have been the need to provide a close fit of the liner to the receptacle walls so as to assure entry of materials being packed solely within the liner and also to prevent the inserted liner from slipping to the bottom of the receptacle or onto the contents therein when one is dropping material into a lined receptacle. Moreover, removing a filled liner from the receptacle, searching for a replacement liner and installing the new liner in the receptacle can be tedious and inconvenient.

Prior receptacles have not solved these problems efficiently. Prior receptacles often require complex, costly, multi-part holding or clamping structures, or are difficult to use even if simplified.

For example, U.S. Pat. No. 5,671,861 discloses a receptacle for removably holding a plurality of loop-handled plastic bags. The receptacle includes cleats projecting upwardly from opposing inside walls and fingers projecting downwardly from other opposing inside walls. The handles of the bags hang from the cleats with the balance of the bag opening pinned against the inside walls by the fingers.

U.S. Pat. No. 4,938,380 discloses a trash receptacle provided with four ears, one at each corner, to support a bag liner preferably having incorporated handles. In particular, the ears are intended to have the bag handles looped around them such that the bag's sides hug the container walls, thus assuring that all refuse is captured within the liner bag. To this end, a tip of each ear protrudes beyond and above a rim around the opening, requiring the handles to be stretched over them, and a notch in the exterior of each ear near the container corner lies well below the rim, causing the bag's edges outside the handle area also to be held in desired relation to the walls.

U.S. Pat. No. 3,825,150 discloses a molded waste receptacle having integral tabs formed in its side walls, the tabs being pressed inwardly to engage a rolled-over edge of a liner bag and pinch it against the receptacle wall when pressing is ended. Simultaneous manipulation of both a tab and the edge requires some dexterity, and furthermore, the occurrence of gaps between the liner bag and the wall is not prevented, allowing waste disposal to occur between liner and receptacle.

U.S. Pat. No. 4,366,916 discloses a packing box for bulk quantities of flexible bags with carrying handles, the box being convertible into a packing unit for the bags, because of provision of pre-perforated front panel and side flaps, the latter folding upward to provide tabs upon which the bag handles are received. Control of gaps between bag and receptacle is not provided and the box is not a leak-proof unit because of the pre-perforations.

U.S. Pat. No. 4,418,835 discloses a pair of wire brackets, each bracket supporting the handle of a liner bag and being fastened in spaced relation to the interior of a respective wall of a trash receptacle. The spacing is necessary for accommodating the user's fingers while inserting and removing the bag, even though such spacing undesirably allows waste disposal to occur between bag and receptacle. Furthermore, if the bag is overfilled, these internally-disposed brackets can present a barrier to easy removal of the liner even though the bag's handles are readily grasped.

U.S. Pat. No. 4,498,652 discloses a wire rack for suspending a plastic bag by its handle loops in an open-mouthed state of the bag, a protective wall being present on one side only (the rack being fastened to a cabinet door on that side).

Accordingly, there is need for a receptacle in which liner support is provided in a simple, low-cost, easily usable fashion, while eliminating gaps between the liner and the receptacle walls which would otherwise undesirably allow packing material to pass into the receptacle outside the confines of the liner. The receptacle should also facilitate storage, removal and replacement of liners.

All references cited herein are incorporated herein by reference in their entireties.

SUMMARY OF THE INVENTION

An improved material packaging system having a plurality of nested liners that are removably attached to each other to form a unitary liner structure. A receptacle having a first attachment device for detachably securing the unitary liner structure to the receptacle is set forth. The unitary liner structure has a second attachment device for detachably securing the second attachment device to the first attachment device of the receptacle. Each of the liners has a pull grip for gripping the liner to remove the liner from the unitary liner structure and perforations disposed between the pull grip and the second attachment device for tearing the liner when a tearing force is applied thereto. An uppermost liner of the plurality of liners can thus be removed from the unitary liner structure without substantially disturbing the positioning of underlying liners by gripping and pulling the pull grip of the uppermost liner to apply the tearing force to the perforations of the uppermost liner

BRIEF DESCRIPTION OF THE DRAWINGS

The invention will be described in conjunction with the following drawings in which like reference numerals designate like elements and wherein:

FIG. 1 is a perspective view of an embodiment of a packaging system of the invention with a partial cross-sectional view;

FIG. 2 is a perspective view of an embodiment of a kit of the invention;

FIG. 3 is a partial cross-sectional view through line 3—3 of FIG. 1;

FIG. 4 is a perspective view of another embodiment of a packaging system of the invention;

FIG. 5 is a perspective view of the nested liners of the embodiment of FIG. 4;

FIG. 6 is a partial cross-sectional view of retractable projections of the invention;

DETAILED DESCRIPTION OF PREFERRED EMBODIMENTS

Figure 7:
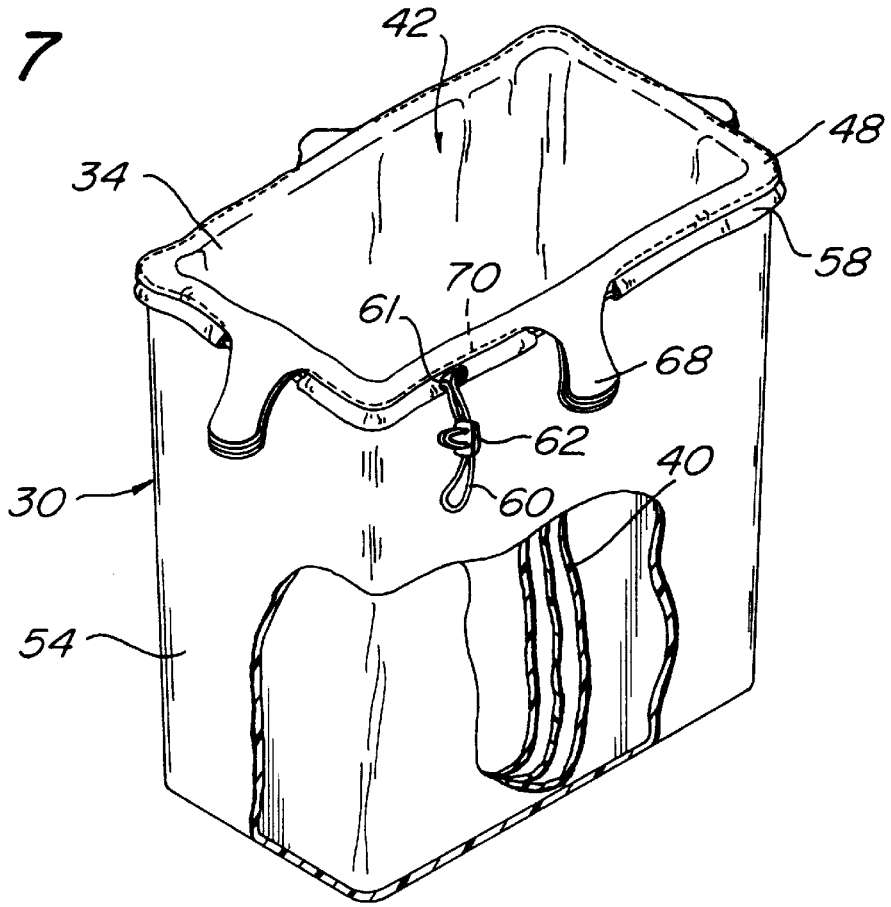
FIG. 7 is a perspective view of a preferred embodiment of a packaging system of the invention including a partial cross-sectional view.

Referring to FIG. 1, the material packaging system 10 comprises a plurality of nested liners 12 for receiving a material (not shown). As best shown in FIGS. 2 and 5, each of liners 12 has a material-receiving mouth 14 at a top end thereof and at least two apertures 16 (preferably at least three apertures 16, as shown) through said top end. Liners 12 are closed at the bottom ends thereof.

System 10 further comprises a receptacle 18 adapted to removably retain nested liners 12 in an open configuration for receiving the material to be packed. The material to be packed is not particularly limited, and can be, e.g., waste.

Receptacle 18 comprises a lip 20 and at least two external projections 22 (preferably at least three external projections 22, as shown) adapted to penetrate apertures 16 when liners 12 are positioned inside receptacle 18. As best shown in FIG. 3, the uppermost portions of liners 12 overlap lip 20. These features combine to removably retain nested liners 12 in receptacle 18. An uppermost one of liners 12 can be removed from receptacle 18 without substantially disturbing the positioning of underlying nested liners in the receptacle.

The shape of liners 12 and receptacle 18 are not particularly limited, except that preferably the shapes of liners 12 should substantially conform to the shape of receptacle 18. For example, the rectangular liners 12 of FIG. 2 are suitable for the rectangular receptacle 18 of FIG. 1, while the cylindrical liners 12 of FIG. 5 are suitable for the cylindrical receptacle 18 of FIG. 4.

Receptacle 18 is preferably open at only the top end thereof. However, in other embodiments, receptacle can be, for example, open along additional areas, and can even be an open frame in which liners 12 are draped. In addition, receptacle 18 can include a lid, although this is not shown in the figures.

The number and placement of apertures 16 and projections 22 are critical factors for maintaining adequate functioning of system 10. It is preferred that there be at least three spaced-apart apertures 16 and three corresponding projections 22, to ensure that liners 12 maintain a close seal over lip 20 of receptacle 18. Having less than three apertures 16 and projections 22 is less preferred (but still within the scope of the invention, which encompasses at least two apertures and at least two projections) because it can result in gapping of liners 12 about lip 20, creating opportunities for the material being packed to bypass liners 12 and enter receptacle 18 directly. There is no particular upper limit on the number of apertures 16 and corresponding projections 22; however, there should not be so many that installation and removal of liners 12 is inconvenient.

Apertures 16 are preferably placed along the top end of liners 12, sufficiently spaced apart to avoid the aforementioned gapping problem. Projections 22 are correspondingly spaced-apart on the outside surface of receptacle 18, so that they readily penetrate the corresponding apertures 16, as shown in FIGS. 1 and 4. Projections 22 can be placed at any relative height along the outside surface of receptacle 18, depending on the desired proportion of each liner 12 to be used for lining the inside of receptacle 18. For example, projections can be placed about 10 cm down the outside surface of receptacle 18, so as to provide a readily grippable portion of liner 12 for removing and sealing liner 12 after it has been filled to the top of receptacle 18. On the other hand, projections 22 can be placed closer to the top of receptacle 18 to minimize the proportion of liner 12 wasted (i.e., the proportion of liner 12 filled with material is maximized).

Apertures 16 are preferably not loop handles for carrying liner 12, but rather are preferably less than about 5 centimeters in diameter, more preferably less than about 2.5 centimeters in diameter.

Projections 22 are preferably hook-shaped, and are placed on the outside surface of receptacle 18 with the hook opening in a downward direction, such that apertures 16 can slide over projections 22 and be held in place by the upward tension provided by the weight of liners 12 within receptacle 18. Projections 22 need not be hook-shaped, however. The shape of projections 22 is dictated by their effect on the ease of installing and removing liners 12 and the stability of the installation during use of system 10.

FIG. 6 shows a retractable projection 22, which retracts from the wall of receptacle 18 to assume a downwardly angled position for receiving and holding liners 12 via apertures 16. Retractable projection 22 demonstrates that the projection need not be curved to function properly.

The materials from which the various elements of system 10 are manufactured are not particularly limited. Non-limiting examples of suitable materials for receptacle 18 and projections 22 include metal, plastic, wood and cardboard. In certain embodiments, projections 22 and receptacle 18 are unitary, in other embodiments they are not unitary. Non-limiting examples of suitable materials for liners 12 include plastic and paper.

FIG. 2 shows the contents of a kit for retrofitting a conventional (or projection-free) receptacle to create a material packaging system. An embodiment of the kit includes rectangular, nested liners 12 having four walls, each wall having a corresponding tongue 24 attached to a top end thereof. Tongue 24 is adapted to overlap receptacle lip 20 and comprises one aperture 16 for receiving a corresponding one of four external projections 22, which are also included in the kit.

Projections 22 preferably include adhesive backing 26 for attachment to the receptacle to be retrofitted.

Figure 8:
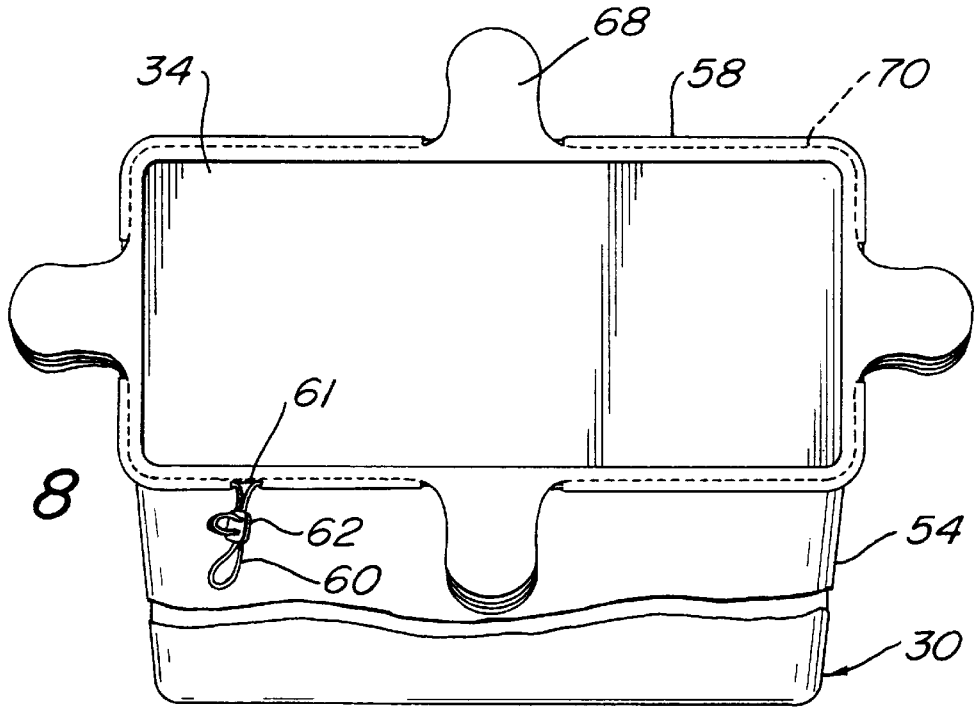
FIG. 8 is a further perspective view of the packaging system of the invention.

Referring to FIGS. 7 and 8, material packaging system 30 is shown. Material packaging system 30 is an alternate embodiment of material packaging system 10. As previously described with respect to material packaging system 10, material packaging system 30 includes a plurality of nested liners 40. Nested liners 40 are formed as unitary liner structure 42. Each nested liner 40 has a material-receiving mouth 34 at a top end thereof. Nested liners 40 are closed at their bottom ends in order to permit them to retain received material.

Material packaging system 30 also includes a receptacle 54 adapted to removably retain nested liners 40 in a open configuration for receiving the material to be packed within liners 40. The material to be packed is not limited and can include, e.g., waste material. Receptacle 54 includes lip 48 extending outwardly from the top thereof. When nested liners 40 are disposed within receptacle 54, an upper circumferential region of unitary liner structure 42 can rest upon lip 48.

Figure 11:
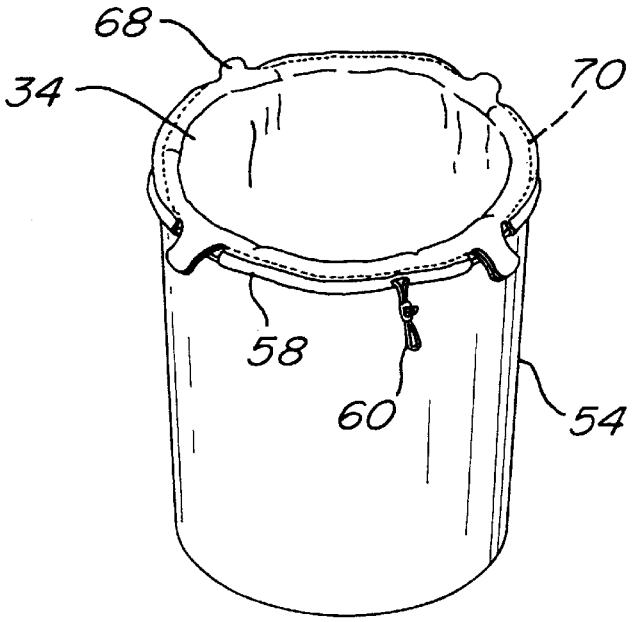
FIG. 11 is a further embodiment of the packaging system of the invention.

The shape of nested liners 40 and receptacle 54 is not limited, except that preferably the shape of liners 40 should substantially conform to the shape of receptacle 54. For example, rectangular liners 40 of FIGS. 7 and 8 are suitable for rectangular receptacle 54 shown therein. Referring to FIG. 11, it can be seen that the shape of receptacle 54 can be, for example, round and that round liners 40 are preferably provided for round receptacle 54.

Receptacle 54 is preferably open at only the top end thereof. However, in other embodiments, receptacle 54 can be open along other areas. Furthermore, receptacle 54 can be an open frame in which nested liners 40 are disposed. Additionally, receptacle 54 can include a lid, although a lid is not shown in the drawings.

Figure 9:
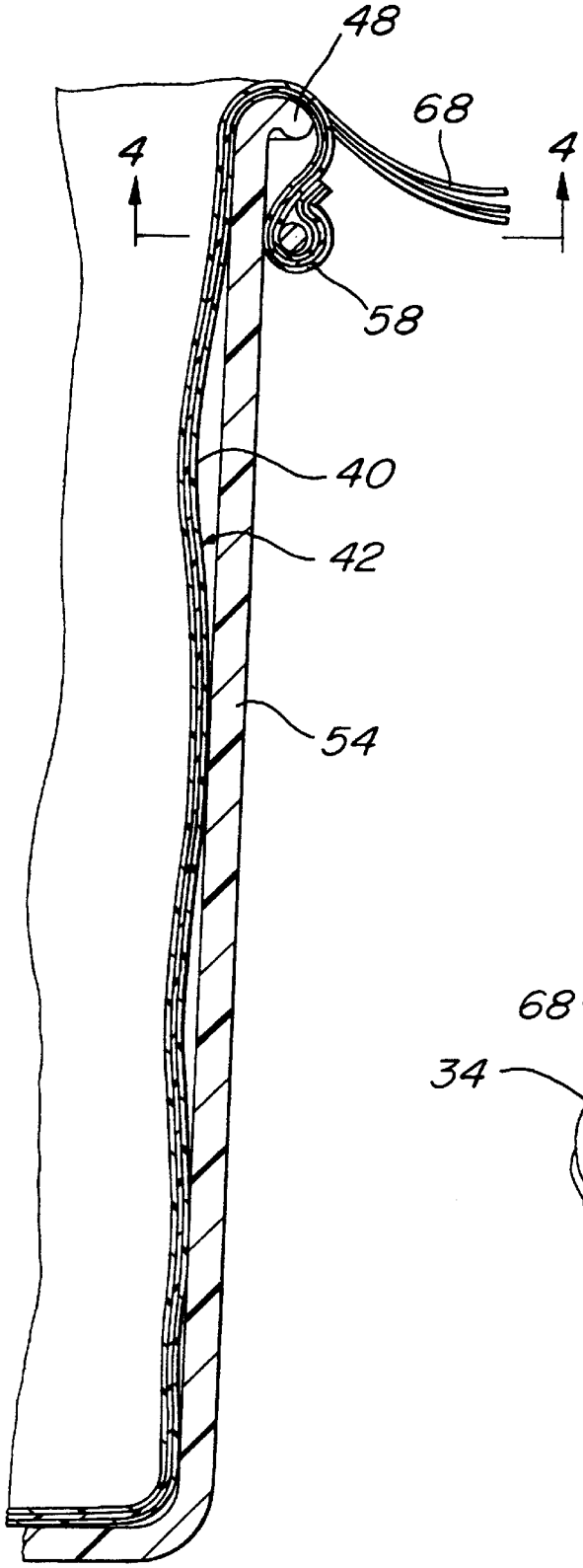
FIG. 9 is a cross-sectional view of the packaging system of the invention.
Figure 10:
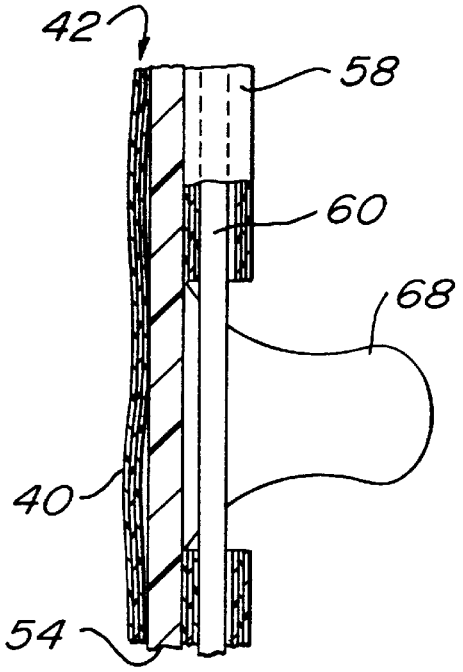
FIG. 10 is a cross-sectional view of the packaging system of the invention.

Referring now to FIGS. 9 and 10, there are shown cross sectional views of material packaging system 30. Within material packaging system 30 unitary liner structure 42 is formed with sheath 58. Sheath 58 can extend around the entire circumference of material-receiving mouth 34 at the top end of nested liners 40. Drawstring 60 (FIG. 7) can extend through the entire length of circumferentially extending sheath 58. An opening 61 is provided through a sidewall of sheath 58 to permit drawstring 60 to extend therethrough for access by a user.

When nested liners 40 are disposed within receptacle 54 the portion of nested liners 40 bearing sheath 58 is adapted to reach from the interior of receptacle 54, over the top of receptacle 54, and to a position below lip 48. When nested liners 54 are installed in receptacle 54 in this manner drawstring 62 is drawn tight by forcibly pulling drawstring 60 away from receptacle 54, thereby drawing a length of drawstring 60 from within sheath 58 by way of opening 61.

A locking clip 62 is provided on drawstring 60 in order to secure drawstring 60 in a tightened position around receptacle 54 and below lip 48. Preferably, locking clip 62 is brought into forcible contact with sheath 58 in the vicinity of opening 61 and forcibly maintained in such a position. In this manner circumferential sheath 58 and thereby unitary liner structure 42 are mated with and tightly secured to receptacle 54 below the exterior of lip 48.

It will be understood by those skilled in the art that it is not necessary for sheath 58 to extend continuously around the entire circumference of unitary liner structure 42. Sheath 58 can be discontinuous provided it extends a sufficient distance to retain drawstring 60 and to secure unitary liner structure 42 to receptacle 54 as described. Furthermore, it is not required that drawstring 60 extend the entire circumferential distance around unitary liner structure 42 provided it is adapted to secure unitary liner structure 42 to receptacle 54. For example, in one embodiment (not shown) drawstring 60 can be attached at two locations along a circumference of unitary liner structure 42 whereby pulling drawstring 62 away from receptacle 54 can draw the two attachment points toward each other and thereby secure unitary liner structure 42 to receptacle 54.

When nested liners 40 of unitary liner structure 42 are secured to receptacle 54 material packaging system 30 is adapted to permit an uppermost liner 40 to be removed from receptacle 54 without substantially disturbing the positioning of an underlying nested liner 40 in receptacle 54. In order to facilitate such a removal of uppermost liner 40 each nested liner 40 is provided with at least one pull tab 68 for gripping a nested liner 40 and pulling the gripped liner 40 away from receptacle 54. In a preferred embodiment four pull tabs 68 are provided on each nested liner 40.

Perforated line 70 is also provided on each liner 40 of the plurality of liners 40 in order to facilitate such a removal of uppermost liner 40. In a preferred embodiment perforated line 70 extends continuously around the entire circumference of unitary liner structure 42, although it is not necessary for perforated line 70 to be continuous or to extend the entire circumference. Perforated line 70 is disposed between sheath 58 and tabs 68. Preferably perforated line 70 extends parallel to sheath 58 and is disposed close to sheath 58.

Perforated line 70 facilitates the tearing of liner 40 from the plurality of liners 40 when a tearing force is applied to the region of perforated line 70. The tearing force for tearing liner 40 along perforated line 70 is applied to the region of perforated line 70 when pull tab 68, on one side of line 70, is pulled away from receptacle 54 while sheath 58, on the opposing side of perforated line 70, remains secured to receptacle 54.

Figure 12:
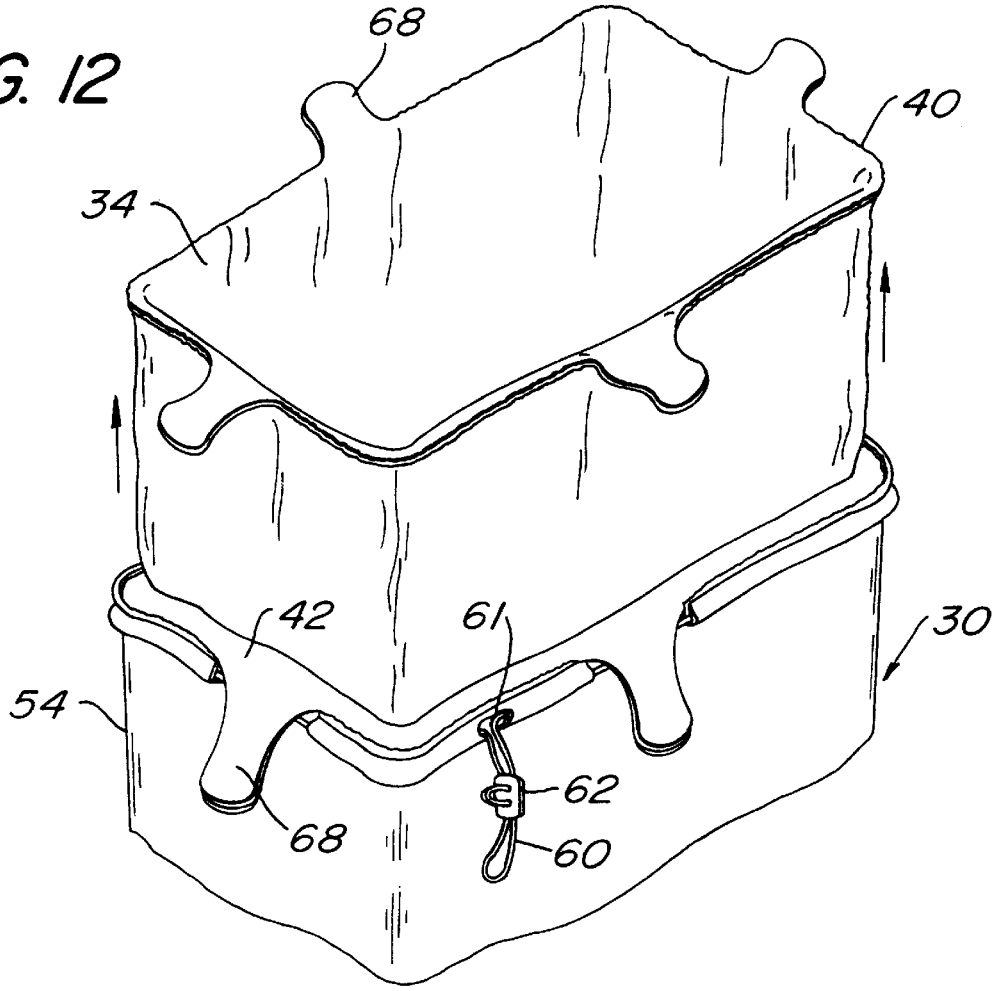
FIG. 12 is a perspective view of the packaging system of the present invention.
Figure 13:
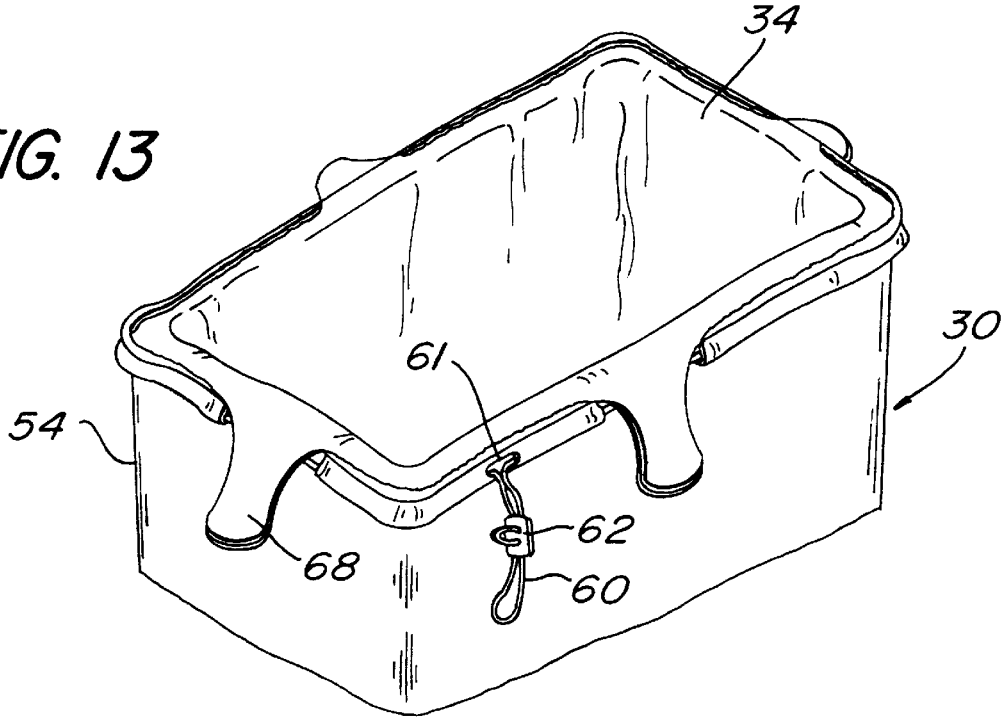
FIG. 13 is a perspective view of the packaging system of the present invention.

Thus, when uppermost liner 40 is ready for removal from receptacle 54 a user can grip pull tab 68 of uppermost liner 40 and pull it upwards and away from receptacle 54. The force away from receptacle 54 applied to uppermost liner 40 causes uppermost liner 40 to tear away from the remainder of the plurality of nested liners 40 along perforation 70. The removal of uppermost liner 40 while the remaining liners 40 are secured to receptacle 54 is shown in FIGS. 12 and 13.

While the sheath retaining structure 48 shown in the drawings is a lip 48, any structure suitable for retaining sheath 58 can be used instead of a lip structure. For example, one or more extensions, including various types of projections, flanges, and hooks, as well as hook and loop material, can serve to retain sheath 58 of unitary liner structure 42 when drawstring 60 is tightened below them. Furthermore, any type of gripping device for gripping and pulling liners 40 can be substituted for pull tabs 68. For example, openings near the top of liners 40 to permit the gripping of liners 40 by inserting a finger or fingers therethrough or even an accessible edge of a liner 40 for permitting the gripping of liner 40 can serve as suitable gripping devices.

The materials from which the various elements of material packaging system 30 are manufactured are not limited. Non-limiting examples of suitable materials for forming receptacle 54 can include metal, plastic, wood and cardboard. Non-limiting examples of suitable materials for nested liners 40 can include plastic and paper.

While the invention has been described in detail and with reference to specific examples thereof, it will be apparent to one skilled in the art that various changes and modifications can be made therein without departing from the spirit and scope thereof.

What is claimed is:

1. An improved material packaging system, comprising:

a plurality of nested liners removably attached to each other to form a unitary liner structure;

a receptacle having a first attachment device for detachably securing said unitary liner structure to said receptacle;

said unitary liner structure having a second attachment device for detachably securing said second attachment device to said first attachment device of said receptacle;

each of said liners having; a pull grip for gripping said liner to remove said liner from said unitary liner structure; perforations disposed between said pull grip and said second attachment device for tearing said liner when a tearing force is applied thereto;

whereby an uppermost liner of said plurality of liners can be removed from said unitary liner structure without substantially disturbing the positioning of underlying liners by gripping and pulling said pull grip of said uppermost liner to apply said tearing force to said perforations of said uppermost liner.

2. The material packaging system of claim 1, wherein said second attachment device extends around an entire circumference of said unitary liner structure.

3. The material packaging system of claim 1, wherein said second attachment device comprises a drawstring.

4. The material packaging system of claim 3, wherein said second attachment device comprises a sheath for retaining said drawstring.

5. The material packaging system of claim 4, wherein both said sheath and said drawstring extend around an entire circumference of said unitary liner structure.

6. The material packaging system of claim 5, wherein said perforations are disposed substantially close to said second attachment device.

7. The material packaging system of claim 6, wherein said perforations are disposed along the side of said second attachment device.

8. The material packaging system of claim 7, wherein each of said liners of said plurality of liners comprises:

a plurality of liner walls defining a material-receiving mouth at a top end of said liner walls; and a closed base joining said liner walls at a bottom end thereof.

9. The material packaging system of claim 8, wherein said receptacle is open at only one end thereof.

10. The material packaging system of claim 1, wherein said perforations are disposed in a line.

11. The material packaging system of claim 1, wherein said perforations extend around an entire circumference of said unitary liner structure.

12. The material packaging system of claim 1, wherein said first attachment device comprises a lip.

13. The material packaging system of claim 1, wherein said first attachment device comprises a hook.

14. The material packaging system of claim 1, wherein said pull grip comprises a pull tab.

15. The material packaging system of claim 1, wherein said material is waste.

16. An improved method for packaging material, comprising the steps of:

removably attaching the nested liners of a plurality of nested liners to each other to form a unitary liner structure;

detachably securing said unitary liner structure to a receptacle by attaching to each other a first attachment device coupled to said receptacle and a second attachment device coupled to said unitary liner structure;

providing each of said liners with; a pull grip for gripping said liner to remove said liner from said unitary liner structure; perforations disposed between said pull grip and said second attachment device for tearing said liner when a tearing force is applied thereto;

gripping and pulling said pull grip of an uppermost liner to apply said tearing force to said perforations and remove said uppermost liner from said unitary liner structure without substantially disturbing the positioning of underlying liners.

17. The material packaging method of claim 16, wherein said second attachment device extends around an entire circumference of said unitary liner structure.

18. The material packaging method of claim 16, wherein said second attachment device comprises a drawstring.

19. The material packaging method of claim 18, wherein said second attachment device comprises a sheath for retaining said drawstring.

20. The material packaging system of claim 16, wherein said perforations are disposed in a line.

21. The material packaging system of claim 16, wherein said perforations extend around an entire circumference of said unitary liner structure.

* * * * *